United States Patent [19]

Satoda et al.

[11] 4,265,614

[45] May 5, 1981

[54] COMBUSTION APPARATUS

[75] Inventors: Hajime Satoda, Yamatokoriyama; Hiromi Ohta; Yoshiyuki Ushirokajitani, both of Nara, all of Japan

[73] Assignee: Matsushita Electric Industrial Co., Ltd., Osaka, Japan

[21] Appl. No.: 52,984

[22] Filed: Jun. 28, 1979

[30] Foreign Application Priority Data

Jun. 28, 1978 [JP] Japan ..... 53-78859
Jun. 28, 1978 [JP] Japan ..... 53-78860

[51] Int. Cl.[3] ..... F23D 13/14; F23D 7/00

[52] U.S. Cl. ..... 431/329; 431/187; 431/351

[58] Field of Search ..... 431/329, 351, 168, 187

[56] References Cited

U.S. PATENT DOCUMENTS

| | | | |
|---|---|---|---|
| 1,953,590 | 4/1934 | Cone | 431/187 |
| 2,862,545 | 12/1958 | Snow | 431/187 |
| 3,377,024 | 4/1968 | Nutten | 431/187 |
| 3,964,859 | 6/1976 | Nishi . | |

*Primary Examiner*—George E. Lowrance
*Attorney, Agent, or Firm*—Spencer & Kaye

[57] ABSTRACT

In a combustion apparatus including a burner head unit for burning a mixture of fuel in a gasified form or in atomized particles and primary air to form a flame, a secondary air ejecting nozzle communicating with secondary air passages functioning as means for cooling the burner head unit is located in the central portion of the burner head unit for injecting secondary air into the central portion of the flame in a stream parallel to the longitudinal axis of the flame to facilitate incorporation of the secondary air in the frame, thereby increasing combustion efficiency and widening the combustion range.

13 Claims, 10 Drawing Figures

COMBUSTION APPARATUS

BACKGROUND OF THE INVENTION

This invention relates to a combustion apparatus including a burner head unit for burning a mixture of air and a liquid fuel in a gaseous state or in an atomized particle state or a mixture of air and a gaseous fuel, and a blower unit for supplying secondary air to a flame formed by the combustion of the fuel-air mixture in the burner head unit. The invention is directed particularly to a combustion apparatus of high combustion efficiency having a wide range of combustion.

In combustion apparatus, one of the important problems is how to increase combustion efficiency and widen the range of combustion. This problem can be solved by providing an improved flame of combustion and by obtaining better mixing of the fuel with air.

To this end, it has hitherto been common practice to supply a mixture of fuel with primary air to the burner head for burning the mixture and forming a flame of combustion, and to blow secondary air into the central portion of the flame from its periphery. In some applications, the secondary air is supplied in a vortical state. However, combustion apparatuses of the prior art have had disadvantages in that the flame does not remain stable and the combustion of the fuel-air mixture produces noise. Moreover, a flame has a self-tightening property, and this makes it difficult to introduce the secondary air to the central portion of a flame. Thus combustion apparatuses of the prior art have been unsuccessful in increasing combustion efficiency and widening the range of combustion above a certain level.

SUMMARY OF THE INVENTION

A first object of the present invention is to provide a combustion apparatus having increased combustion efficiency and a widened range of combustion, wherein noise generated due to an unstable flame can be avoided.

A second object is to provide a combustion apparatus wherein a rise in the temperature of the burner head where a flame is formed is minimized and a backfire or other abnormal state of combustion is prevented from occurring.

A third object is to provide a combustion apparatus wherein the burner head incorporates therein various improvements to enable improved combustion performance.

According to the present invention, there is provided a combustion apparatus capable of supplying secondary air to the central portion of a flame by causing the secondary air to flow in a stream parallel to the longitudinal axis of the flame, thereby loosening the self-tightening flame by the stream of secondary air to provide improved mixing of the secondary air in the flame and to obtain a laminar flame without any irregularities.

DESCRIPTION OF THE PREFERRED EMBODIMENTS

Preferred embodiments of the present invention will be described by referring to the accompanying drawings.

Figure 1:
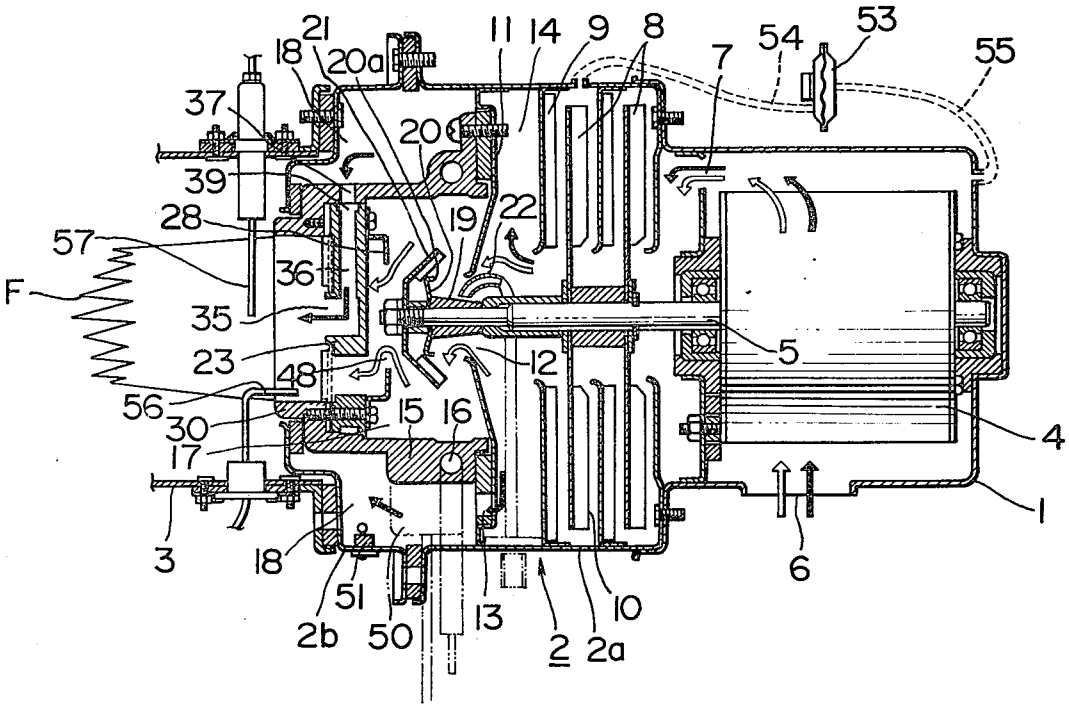
FIG. 1 is a vertical sectional view of the liquid fuel combustion apparatus comprising one embodiment of the present invention.

FIG. 1 shows a rotary liquid fuel combustion apparatus of the vaporizing type comprising a cylindrical motor case 1, a cylindrical burner case 2 consisting of a first burner case 2*a* and a second burner case 2*b*, and a combustion cylinder 3. The combustion cylinder 3, the second burner case 2*b* and the first burner case 2*a* are connected to one another through a heat-resisting packing being which is mounted between the combustion cylinder 3 and the second burner case 2*b* and between the second burner case 2*b* and first burner case 2*a*. An electric motor 4 is fitted in the motor case 1 and has an output shaft 5 extending through the burner case 2 to have its forward end located in the vicinity of the combustion cylinder 3. The motor case 4 is provided in its side wall with an air inlet 6 and in one end wall adjacent the burner case 2 with a plurality of communicating openings 7 circularly arranged so as to maintain the interior of the motor case 4 in communication with the interior of the burner case 2. A two stage fan-blade assembly 8 is fitted to the output shaft 5 substantially midway of the output shaft, and has guide vanes 9 secured to the burner case 2 and located on the discharge side of each stage of fans of the fan-blade assembly 8. The fan-blade assembly 8 cooperates withe the guide vanes 9 so as to provide a compressor 10. If the number of stages of the fan-blade assembly is increased, it results in an increase of static pressure.

A partition plate 11 is secured to the inner wall surface of the burner case 2 in a position suitably spaced apart from the last stage of the guide vanes 9 and has a primary air inlet port 12 of a relatively large size formed in its central position to allow the output shaft 5 of the electric motor 4 to extend therethrough. The partition plate 11 is formed with a plurality of secondary air inlet openings 13 of relatively small size formed in its outer peripheral portion. The last stage of guide vanes 9 and the partition plate 11 define therebetween an air branching chamber 14 where the air fed through the fan-blade assembly 8 is divided into two portions: one portion flows through the primary air inlet port 12 in the partition plate 11 to be supplied as the primary air, and the other portion flows through the secondary air inlet openings 13 in the partition plate 11 to be used as the secondary air.

Figure 3:
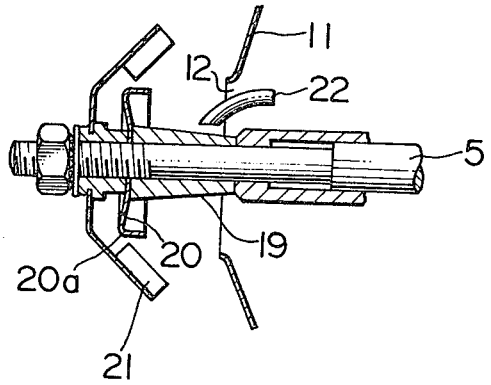
FIG. 3 is a perspective view, on an enlarged scale, of the fuel atomizing mechanism of the combustion apparatus shown in FIG. 1.

A vaporizing cylinder 15 substantially cylindrical in shape is mounted in the burner case 2 in a position downstream of the partition plate 11. The vaporizing cylinder 15 is formed of metal of high thermal conductivity, such as aluminum, is fabricated as for example by die casting, and has a preheating unit 16 (sheathed heaters) embedded in its wall in a position close to the partition plate 11. The vaporizing cylinder 15 is connected at one end through a heat-insulating packing to the partition plate 11, and is connected at the other end to the wall of an open end of the second burner case **2*b* through a heat-insulating packing. The second burner case 2*b* is formed by, for example, deep drawing. The vaporizing cylinder 15 defines therein a vaporizing chamber 17 in communication with the primary air inlet port 12, and the vaporizing cylinder 15 and the burner case 2 define therebetween a secondary air chamber 18 in communication with the secondary air inlet openings 13. The output shaft 5 of the electric motor 4 is provided in its forward end portion with a conical member 19, a shake-off disk 20 and an unbrella-shaped agitating blade assembly 21 arranged in the indicated order and held in place by a fixing nut to constitute a rotor assembly as shown in FIG. 3. The conical member 19 is tapering from the forward end of the shaft 5 toward the motor 4 and has a gentle slope. The shake-off disk 20 located at the major diameter end of the conical member 19 has an outer peripheral portion of the disk bent toward the conical member 19 so as to provide a smooth wall portion 20*a*. The agitating blade assembly 21 located forwardly of the shake-off disk 20 has a disk deep-drawn in a manner to cause its outer peripheral portion to taper, and a plurality of blades formed by cutting and bending the tapering portion of the disk. The preheating unit 16 is located in a portion of the wall of the vaporizing cylinder 15 which is disposed close to the outer periphery of the agitating blade assembly 21**.

The numeral 22 designates a liquid fuel supply conduit for allowing a supply of liquid fuel (kerosene) to flow therethrough from a pump, not shown. The liquid fuel supply conduit 22 extends radially of the branching chamber 14 and has a forward end portion located in a position slightly above the output shaft 5 as shown in FIG. 1 where the conduit 22 is bent in the form of an inverted letter U so that the end of the conduit 22 is located in a manner such that its opening is disposed above and in the vicinity of the conical member 19. The portion of the partition wall 11 surrounding the primary air inlet port 12 slightly tapers to project at a certain distance into the vaporizing chamber 17 so that the primary air inlet port 12 in the center of the partition plate 11 encircles the forward end of the liquid fuel supply conduit 22 disposed in the vicinity of the conical member 19. The numeral 23 designates a burner head unit secured to the forward end of the vaporizing cylinder 15, which faces the combustion cylinder 3. The burner head unit 23 will be described in detail hereinafter by referring to FIGS. 4 to 7.

Figure 4:
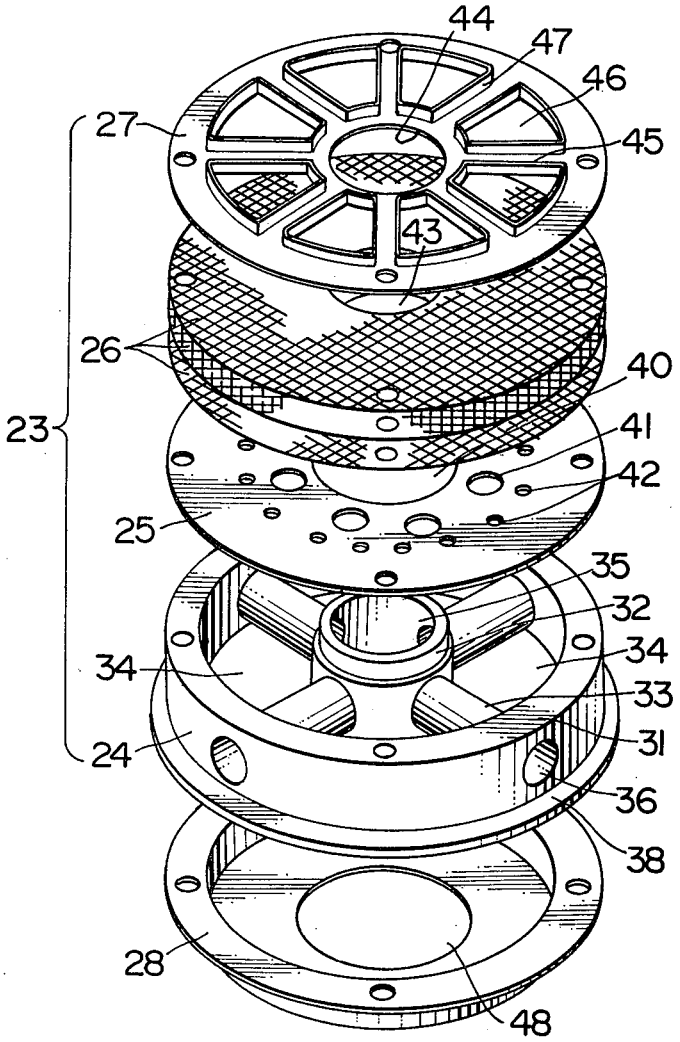
FIG. 4 is an exploded perspective view of the burner head unit of the combustion apparatus shown in FIG. 1.
Figure 5:
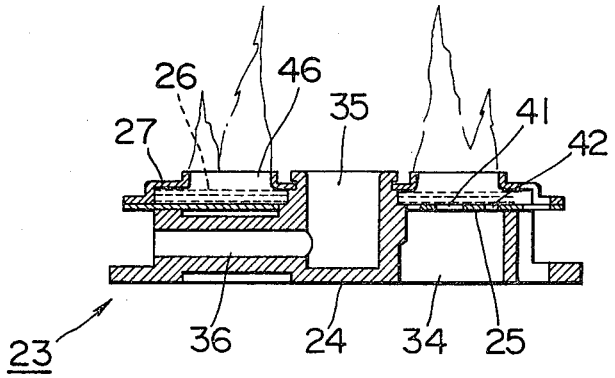
FIG. 5 is a sectional view of the burner head unit shown in FIG. 4.
Figure 6:
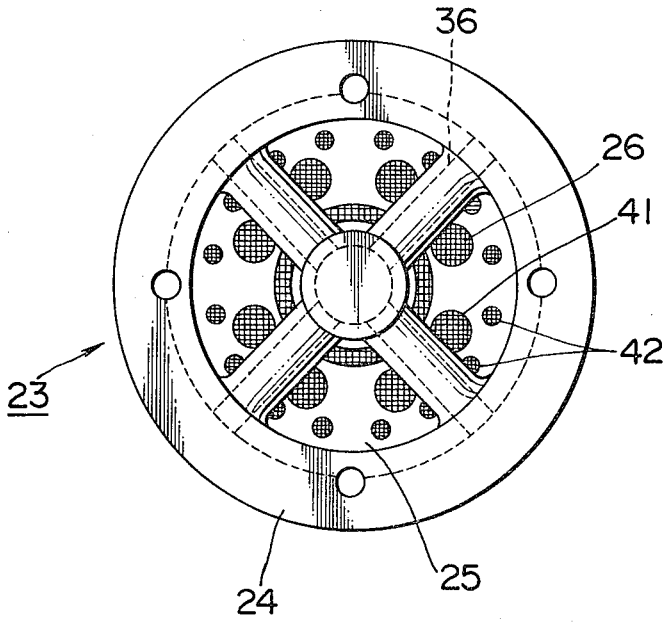
FIG. 6 is a rear end view of the burner head unit shown in FIG. 4.
Figure 7:
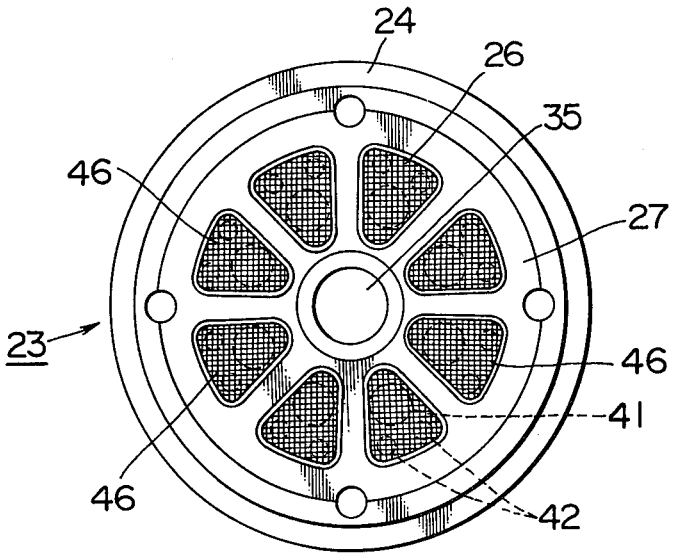
FIG. 7 is a front end view of the burner head unit shown in FIG. 4.

The burner head unit 23 shown in FIG. 4 comprises a head body 24, a pressure equalizing plate 25, a plurality of porous flame-port plates 26 laid one upon the other, and a retaining plate 27 connected together in the indicated order into a unitary structure. A flow rectifying plate 28 is attached to a surface of the head body 24 constituting the bottom wall of the burner head unit 23, and the burner head unit 23 is inserted in this condition into the vaporizing cylinder 15 and bolted to a shoulder 29 of the vaporizing cylinder 15 formed near its opening (See FIG. 2). The portion of the vaporizing cylinder 15 disposed forwardly of the shoulder 29 constitutes a heat recovery section 30 heated by a flame F.

The head body 24 is made of, for example, an aluminum die casting, and comprises an outer annular portion 31, a hub 32 and a plurality of arms 33 interconnecting the hub 32 and the outer annular portion 31, the arms 33 defining therebetween openings 34. The hub 32 is formed with an opening serving as a secondary air ejecting nozzle 35 facing toward the center axis of the combustion cylinder 3. To supply secondary air from the secondary air chamber 18 to the secondary air ejecting nozzle 35, secondary air passages 36 communicating with the secondary air ejecting nozzle 35 are each formed in one of the arms 33. Secondary air feeding openings 37 are formed in the vaporizing cylinder 15 in positions corresponding to those of the secondary air passages 36 so that the secondary air from the secondary air chamber 18 flows through the secondary air feeding openings 37 and the secondary air passages 36 into the secondary air ejecting nozzle 35 and then is injected therefrom into the combustion cylinder 3. The head body 24 is formed at the under edge of its outer periphery with an annular flange 38. By this arrangement, when the burner head unit 23 is fixedly placed inside the vaporizing cylinder 15, an annular air sump 39 is formed between the outer periphery of the head body 24 and the inner periphery of the vaporizing cylinder 15 to enable the plurality of secondary air passages leading from the secondary air chamber to the secondary air ejecting nozzle to communicate with one another.

The pressure equalizing plate 25 is formed at its center with an opening 40 greater in diameter than the hub 32 of the head body 24 to permit the latter to extend therethrough. The plate 25 is also formed with a plurality of openings 41 of a comparatively larger diameter arranged annularly in a portion of the plate 25 surrounding the center opening 40, and a plurality of openings 42 of a comparatively smaller diameter arranged annularly in a portion of the plate 25 outside the portion thereof in which the openings 41 are formed. The ratio of the number of the larger diameter openings 41 to that of the smaller diameter openings 42 is 1:2. The pressure equalizing plate 25 is positioned in the burner head assembly 23 in such a manner that the portions thereof in which the larger and smaller diameter openings 41 and 42 are formed are juxtaposed against the openings 34 defined between the arms 33 of the head body 24.

The plurality of porous flame-port plates 26 are formed in the center with openings 43 for permitting the hub 32 of the head body 24 to be fitted therein. It is necessary that the plurality of the porous flameport plates 26 have good air-permeability even if they are laid one upon the other. To this end, when the plates 26 are formed of wire-netting, they are laid one upon the other in such a manner that the mesh of one plate is at right angles to the mesh of the other plate to enable the assembly of plates 26 to have good air-permeability.

The retaining plate 27 is formed at its center with an opening 44 for permitting the hub 32 of the head body 24 to be fitted therein, and has a plurality of spokes 45 extending from its center to its outer periphery to define therebetween a plurality of flame ports 46. The spokes 45 and the outer periphery of the retaining plate 27 have forwardly extending walls 47 surrounding the flame ports 46 which are eight (8) in number in the embodiment shown and described herein. The retaining plate 27 is positioned in the burner head unit 23 in such a manner that each of the flame ports 46 is aligned with one large diameter opening 41 and two small diameter openings 42 of the pressure equalizing plate 25. After the pressure equalizing plate 25, the porous flame-port plates 26 and the retaining plate 27 are successively placed one upon another, they are secured together as by spot welding or caulking in their outer peripheral portions into a unitary structure. The assembly of plates thus produced is placed on the head body 24 by inserting the hub 32 of the latter into the center opening of the former, and the edge of the secondary air ejecting nozzle 35 formed in the hub 32 is spread out and caulked to securely fix the head body 24 to the assembly, thereby completing the fabrication of the burner head unit 23.

The flow rectifying plate 28 is in the form of a pan and has a small open space interposed between the flow rectifying plate 28 and the head body 24, and has formed in its center portion an opening 48 of a diameter smaller than the outer diameter of the openings 34 formed in the head body 24 and the outer diameter of the agitating blade assembly 21. When the flow rectifying plate 28 is disposed in the vaporizing cylinder 15 together with the burner head unit 23, the plate 28 is positioned downstream of the agitating blade assembly 21 of the rotor assembly but closely thereto. Thus a stream of a mixture of secondary air and the liquid fuel converted into a gaseous state in the vaporizing cylinder 15 is throttled as it flows through the opening 48 in the center of the flow rectifying plate 28 so that the quantity of the mixture flowing through the opening 48 is rendered uniform and mixing of the components of the mixture is promoted.

Figure 2:
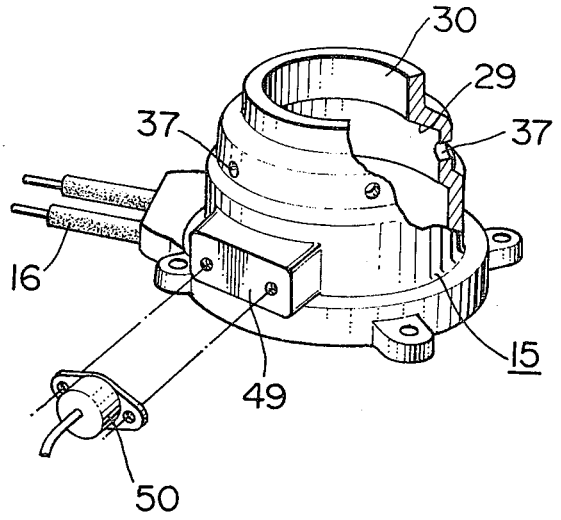
FIG. 2 is a perspective view, with certain parts being cut out, of the gasifying cylinder of the combustion apparatus shown in FIG. 1.

In FIG. 2, the vaporizing cylinder 15 is formed at its outer periphery with a thermostat mounting portion 49 secured unitarily thereto for mounting a burner thermostat 50 in intimate contact with the vaporizing cylinder 15. The burner thermostat 50 has the function of controlling temperature in the burner case 2. The numeral 51 designates in FIG. 1 a temperature fuse attached to the burner case 2 and facing the secondary air chamber 18. The numeral 53 designates an air pressure switch connected to the compression chamber 10 and the motor case 4 through pressure introducing tubes 54 and 55 for detecting the pressure difference so as to check whether air is being supplied. The numeral 56 designates an igniting electrode extending from a portion of the combustion cylinder 3 toward the burner head unit 23. The numeral 57 designates a flame rod for detecting the state of combustion, which is connected to a portion of the combustion cylinder 3 in a manner to be positioned in the flame F forwardly of the burner head unit 23.

The operation of the combustion apparatus constructed as aforesaid will now be described. Prior to the initiation of combustion, a current is passed to the preheating unit 16 to preheat the vaporizing cylinder 15. Upon the temperature in the vaporizing cylinder 15 rising to a predetermined level which is high enough to obtain vaporizing of a liquid fuel, the burner thermostat 50 is turned on to start the electric motor 4. Rotation of the output shaft 5 of the motor 4 causes the fan-blade assembly 8, the conical member 19, the shake-off disk 20 and the agitating blade assembly 21 to rotate. As the fan-blade assembly 8 produces air pressure, air to be mixed with the fuel for combustion is introduced through the air inlet 6 into the motor case 4 from which the air passes through the communicating openings 7 and the compression chamber 10 into the branching chamber 14 where the air is divided into two streams: one air stream flows through the primary air inlet port 12 into the vaporizing chamber 17 as primary air, and the other air stream flows through the secondary air inlet openings 13 into the secondary air chamber 18 as secondary air.

Meanwhile initiation of feeding of air is detected by the air pressure switch 53, and the fuel pump is actuated to commence the supply of a liquid fuel through the liquid fuel supply conduit 22 to the conical member 19 on the output shaft 5 of the motor 4. The liquid fuel supplied to the conical member 19 which is rotating is passed by centrifugal forces from the smaller diameter portion of the conical member 19 to the larger diameter portion thereof, and then reaches the shake-off disk 20 where the liquid fuel is passed from the center toward the outer periphery. At the outer peripheral edge of the shake-off disk 20, the liquid fuel is scattered from the disk 20 outwardly thereof. As the liquid fuel is scattered in this way, the liquid fuel spreads in a thin fuel layer which is broken into small fragments by the agitating blade assembly 21 rotating around the outer periphery of the shake-off disk 20. Thus the liquid fuel is converted into atomized particles which spread extensively toward the inner periphery of the vaporizing cylinder 15. Since the vaporizing cylinder 15 is preheated as described hereinabove, the atomized particles of liquid fuel are instantaneously gasified.

The primary air supplied through the primary air inlet port 12 to the vaporizing cylinder 15 is mixed with the gasified fuel to produce a stream of a mixture of gasified fuel and primary air. The gasified fuel and the primary air in this mixture are thoroughly mixed as the mixture flows through the opening 48 in the center of the flow rectifying plate 28 so as to enable a fuel-air mixture of uniform proportions to be obtained. The stream of the fuel-air mixture of uniform proportions flows through the openings 34 defined between the arms 33 in the head body 24, the openings 41 and 42 of larger and smaller diameters formed in the pressure equalizing plate 25, the porous flame-port plates 26 and the flame ports 46 formed in the retaining plate 28. By actuating the ignition electrode 56 at this time, a blue flame F can be formed in the burner head unit 23. The initiation of combustion is detected by the combustion detecting flame rod 57.

Meanwhile the stream of the secondary air supplied to the secondary air chamber 18 flows through the secondary air feeding openings 37 in the vaporizing cylinder 15 and collects in the air sump 39 from which the secondary air flows through the secondary air passages 36 into the secondary air ejecting nozzle 35 to be injected therefrom, into the central portion of the flame F parallel to the longitudinal axis of the flame F. The stream of the secondary air vigorously injected into the central portion of the flame F has the effect of loosening the self-tightening tendency of the flame F, so that components of the flame F are spread by the stream of the secondary air to enable the latter to be uniformly incorporated in the former. The stream of the secondary air flows parallel to the longitudinal axis of the flame F as aforesaid so that the flame F is not disturbed by the stream of the secondary air and its stability remains unchanged. This permits the seconday air to be smoothly incorporated in the flame F.

Figure 8:
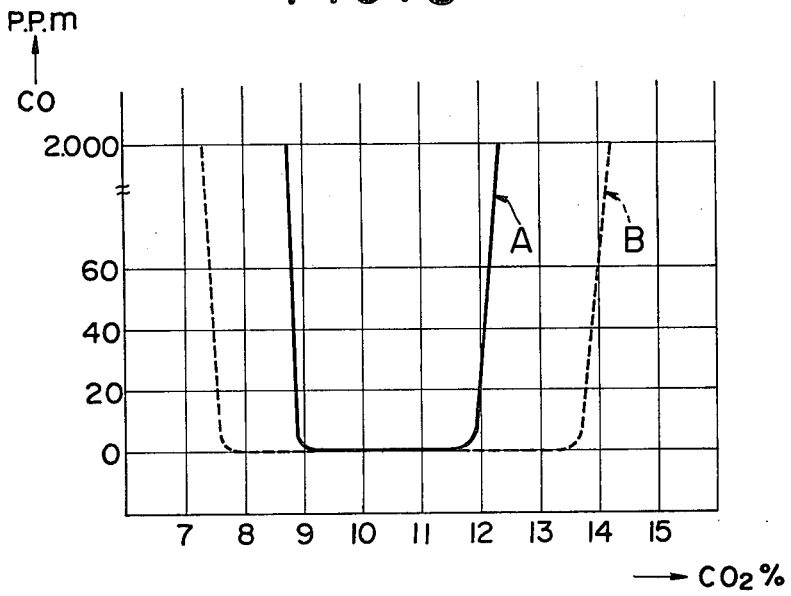
FIG. 8 is a graph showing the range of combustion.

FIG. 8 is a graph showing the combustion range by comparing $CO_2$ with CO at the time when kerosene is burned. A solid line A represents the result obtained with a combustion apparatus of the prior art which generally shows a combustion range of about 3%, and a broken line B indicates the result obtained with the combustion apparatus of the present invention which shows a combustion range of about 6%. This shows that the present invention enables complete combustion to be obtained in the vicinity of the theoretical air volume and permits combustion to take place stably even if there is an excess air supply.

From the foregoing description, it will be appreciated that in the embodiment shown and described hereinabove, the secondary air injected into the central portion of the flame F flows through the secondary air passages 36 formed in the arms 33 of the head body 24 before being ejected through the secondary air ejecting nozzle 35. By virtue of this arrangement, the burner head unit 23 including the head body 24 and the flame port means downstream of the head body 24, which includes the pressure equalizing plate 25 and the flame-port plates 26 is as a whole cooled by the secondary air, thereby minimizing a rise in the temperature in the burner head unit 23. Thus an inordinate rise in the temperature in the burner head unit 23 and a resultant increase in the combustion speed which would mean an unbalance in the rate at which the gas-air-mixture is ejected and in the rate at which combustion of the gas-air-mixture occurs could be avoided, permitting the gas-air-mixture to burn stably without causing a back-fire to occur.

The secondary air passing from the secondary air feeding openings 37 of the vaporizing cylinder 15 to the secondary air passages 36 in the arms 33 of the head body 24 temporarily collects in the air sump 39 between the inner periphery of the vaporizing cylinder 15 and the outer periphery of the head body 24. The provision of the air sump 39 has the effect of maintaining the uniformity of the quantity of the secondary air even if indexing of the secondary air passages 36 of the head body 24 with the secondary air feeding opening 37 of the vaporizing cylinder 15 is not obtainable, thereby permitting the cooling action of the secondary air to be performed evenly and increased stability of combustion to be obtained. This eliminates the need to perform the time-consuming working step of indexing the secondary air passages 36 of the head body 24 with the secondary air feeding openings 37 of the vaporizing cylinder 15 when the head body 24 is assembled in the combustion cylinder 3, thereby enabling working efficiency to be increased.

The gas-air mixture stream ejected from the burner head 23 passes through both the larger diameter openings 41 and smaller diameter openings 42 formed in the pressure equalizing plate 25. This increases the rate of flow of the stream in the central portion thereof and reduces the rate of flow of the stream in the outer peripheral portion thereof.

As a result, the flame F formed in the burner head unit 23 is composed of a large flame portion which is stably held without back-fire in the center of the flame and a small flame portion which is also stably held without lifting-fire in the outer peripheral portion of the flame. This is effective to increase the stability of combustion.

The gas-air mixture stream ejected from the burner head unit 23 is divided into a plurality of substreams by the flame ports 46 of the retaining plate 27. This permits the flame formed in the flame ports 46 to be divided into a plurality of flame portions to increase combustion efficiency. At the same time, the forwardly extending walls 47 formed at the edge of the flame ports 46 have the effect of preventing the flow rate of the mixture from increasing, and the forwardly extending walls 47 themselves are heated by the flame F to thereby increase the length of the flame F. Thus combustion takes place stably with the flame continuing its existence without interruption, and the combustion range is greatly increased when air becomes excessive in quantity. More specifically, as shown in FIG. 8, the lower limit combustion has 9.0% of $CO_2$ in the conventional combustion apparatus, but the present invention has reduced the lower limit of combustion to about 7.5% of $CO_2$. This indicates that the combustion apparatus according to the invention has improved stability when air is supplied in excess.

The liquid fuel delivered to a position above the conical member 19 through the liquid fuel supply conduit 22 impinges on the wall portion **20*a* of the shake-off disk 20 as the liquid fuel moves downwardly in drops. Although for a very short time, the liquid fuel temporarily becomes stationary and the quantity of fuel scattered in particles outwardly can be rendered uniform. The liquid fuel supplied to the burner head unit 23 through the center opening 48 of the flow rectifying plate 28 is throttled as it passes through the opening 48 so that the flow of the liquid fuel temporarily stagnates just prior to its introduction into the opening 48. This phenomenon is also effective to obtain uniform scattering of liquid fuel. Thus even if the stream of the liquid fuel delivered by the fuel pump tends to pulsate, this tendency is prevented from affecting the smooth flow of fuel from the flow rectifying plate 28 to the burner head unit 23, thereby enabling the flame F formed in the burner head unit 23 to become very stable. The flame F heats the heat recovery section 30 of the vaporizing cylinder 15 and keeps the whole of the vaporizing cylinder 15 at high temperature. This permits electrical power consumption to be eliminated since the supply of a current to the preheating unit 16 can be cut-off after the lapse of a suitable time following detection of combustion by the flame rod 57**.

Figure 9:
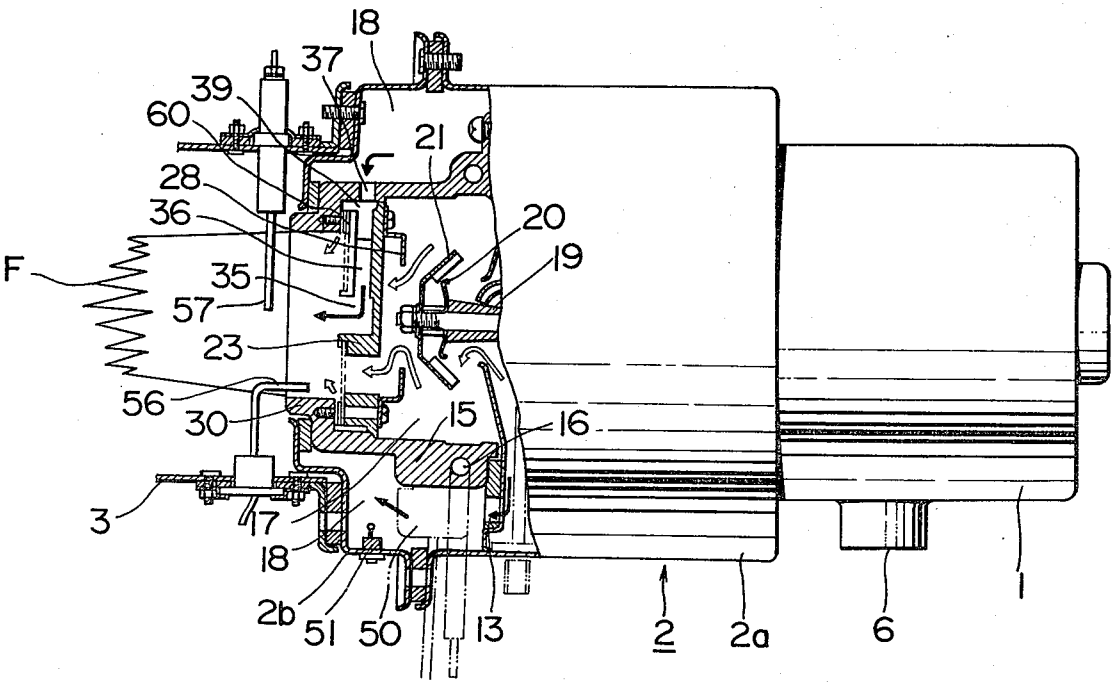
FIG. 9 is a sectional view of the essential portions of the combustion apparatus comprising another embodiment of the present invention.
Figure 10:
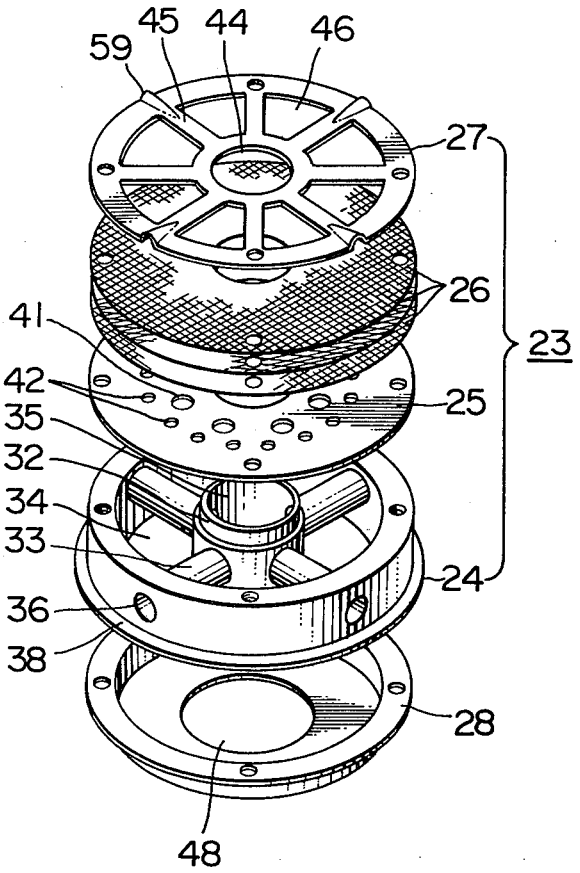
FIG. 10 is an exploded perspective view of the burner head unit of the combustion apparatus shown in FIG. 9.

FIGS. 9 and 10 show another embodiment of the present invention wherein the burner head unit 23 is modified so that the retaining plate 27 has bulges 59 formed in its outer peripheral portion in positions which are indexed with the spokes 45. When the retaining plate 27 of this construction is assembled with the porous flame-port plates 26 and other elements to constitute the burner head unit 23 to be fitted in the vaporizing cylinder 15, auxiliary secondary air passages 60 are formed between the air sump 39 and the porous flame-port plate 46. This arrangement has the effect of injecting auxiliary secondary air from the air sump 39 into the flame portions of the flame F in the flame ports 46, thereby promoting incorporation of the secondary air in the flame F and increasing combustion efficiency.

In the embodiments shown and described hereinabove, a single secondary air ejecting nozzle is provided in the center of the burner head unit and a flame is formed in a manner to surround the secondary air ejecting nozzle. It is to be understood, however, that the invention is not limited to this arrangement and that a plurality of secondary air ejecting nozzles may be provided in a plurality of positions in the burner head unit so that a plurality of flames may be formed in such a manner that each flame surround one of the secondary air ejecting nozzles.

What is claimed is:

1. A combustion apparatus comprising:

i. a burner case;

ii. means for producing a mixture of fuel and air to be burned;

iii. a fuel supply for feeding said fuel to said producing means;

iv. means for supplying primary air to said producing means;

v. means for supplying secondary air; and vi. a burner head unit, disposed in said burner case, including a secondary air ejecting nozzle and flame port means surrounding said secondary air ejecting nozzle, said burner head unit burning said mixture fed from said producing means so as to form a flame having an inner lateral surface and an outer lateral surface, said secondary air ejecting nozzle being arranged to feed a laminated flow of said secondary air into contact with the inner lateral surface of said flame.

2. A combustion apparatus as set forth in claim 1, wherein said burner head unit further comprises a head body located upstream of said flame port means, said head body having at least one secondary air passage formed therein which communicates with the central portion of said flame port means.

3. A combustion apparatus as set forth in claim 2, wherein said head body comprises an outer annular portion, a hub, and a plurality of arms interconnecting said hub and said outer annular portion, at least one of said arms being hollow to define therein said secondary air passage for permitting secondary air to flow therethrough, said hub being formed with an opening serving as said secondary air ejecting nozzle.

4. A combustion apparatus as set forth in claim 3, wherein said producing means includes a cylindrical member surrounding said head body, said cylindrical member and said burner case defining a secondary air chamber therebetween, said cylindrical member having secondary air feeding openings therein for maintaining communication between said secondary air passage and said secondary air chamber, an annular air sump being formed between the inner periphery of said cylindrical member and the outer periphery of said head body, said annular air sump communicating with said secondary air passage formed in an arm of said head body.

5. A combustion apparatus as set forth in claim 2, wherein a mixture of gasified fuel and primary air flows in a stream in which the flow rate is higher in its central portion than in its outer peripheral portion.

6. A combustion apparatus as set forth in claim 2 or 5, wherein said flame port means comprises a pressure equalizing plate having openings therein, at least one porous flame-port plate formed of wire netting and laid on said pressure equalizing plate, and a retaining plate having a plurality of flame ports therein laid on said porous flame-port plate, said pressure equalizing plate, porous flame-port plate and retaining plate being assembled into a unitary structure.

7. A combustion apparatus as set forth in claim 6, wherein said flame ports are each formed with forwardly extending walls along the edges thereof.

8. A combustion apparatus as set forth in claim 6, wherein said flame ports are defined by spokes, auxiliary air passages being formed at the periphery of said flame ports for supplying said auxiliary secondary air from extensions of said spokes.

9. A combustion apparatus as set forth in claim 8, wherein said primary air supplying means and said secondary air supplying means are supplied with pressurized air from a blower unit.

10. A combustion apparatus as set forth in claim 9, wherein said fuel supply supplies a liquid fuel and said producing means comprises a rotary type fuel atomizing mechanism including a rotatable rotor assembly for converting said liquid fuel into atomized particles, the centrifugal forces produced by said rotating rotor assembly scattering said atomized particles into said primary air; and vaporizing means for heating and vaporizing said atomized particles of said liquid fuel to form a gasified fuel, whereby said gasified fuel is mixed with the primary air to form the mixture of gasified fuel and primary air supplied to the burner head unit for combustion.

11. A combustion apparatus as set forth in claim 10, wherein said vaporizing means comprises a cylindrical member surrounding the outer periphery of said head body.

12. A combustion apparatus as set forth in claim 10, wherein said vaporizing means includes a forward end portion extending into a position in which the forward end portion is brought into contact with a flame formed in the burner head unit and constitutes a heat recovery section.

13. A combustion apparatus as set forth in claim 10, further comprising a flow rectifying plate located upstream of said burner head unit to provide means for temporarily restricting the flow of said mixture.

* * * * *